US006370827B2

(12) United States Patent
Chalich

(10) Patent No.: US 6,370,827 B2
(45) **Date of Patent: *Apr. 16, 2002**

(54) GROUND ANCHOR ROD STABILIZER

(76) Inventor: Dan Chalich, 14278-86th Ave. N., Seminole, FL (US) 33776

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/459,043

(22) Filed: Dec. 10, 1999

(51) Int. Cl.[7] ..... E02D 5/80

(52) U.S. Cl. ..... 52/155; 52/157; 52/158; 52/159; 52/166; 52/125.4

(58) Field of Search ..... 52/157, 158, 159, 52/125.4, 125.2, 155, 166; 135/118, 88.06

(56) References Cited

U.S. PATENT DOCUMENTS

| | | | | | |
|---|---|---|---|---|---|
| 196,003 | A | * | 10/1877 | Frey | 52/158 |
| 598,003 | A | | 1/1898 | Oliver | |
| 624,724 | A | | 5/1899 | Alter | |
| 649,416 | A | * | 5/1900 | Terry | 52/157 |
| 672,625 | A | | 4/1901 | Mullenix et al. | |
| 897,787 | A | | 9/1908 | Ryan | |
| 903,944 | A | | 11/1908 | Andersen | |
| 911,504 | A | | 2/1909 | Jay | |
| 1,108,535 | A | * | 8/1914 | Westphall et al. | 52/159 |
| 1,214,679 | A | | 2/1917 | Hindmarsh | |
| 1,764,207 | A | | 6/1930 | Walton | |
| 3,011,597 | A | | 12/1961 | Galloway et al. | |
| 3,032,149 | A | | 5/1962 | Manghise | |
| 3,139,163 | A | * | 6/1964 | Haller | 52/155 |
| 4,052,827 | A | | 10/1977 | Yancey | |
| 4,098,041 | A | * | 7/1978 | Frye | 52/155 |
| 4,258,514 | A | * | 3/1981 | St. Clair | 52/86 |
| 4,756,128 | A | | 7/1988 | Danieli | |
| 4,939,877 | A | | 7/1990 | Claffey | |
| 5,503,500 | A | | 4/1996 | Oliver et al. | |
| 5,864,993 | A | * | 2/1999 | Wells | 52/155 |

* cited by examiner

*Primary Examiner*—Carl D. Friedman
*Assistant Examiner*—Phi Dieu Tran A
(74) *Attorney, Agent, or Firm*—Larson & Larson, P.A.; James E. Larson

(57) ABSTRACT

A ground anchor rod drilled into soil is held in place by a generally rectangular stabilizer having various side thicknesses of about 2–1 cm from a top to a bottom portion and a front and backside having a width of about 20 cm. The front face contains multiple depressions over its entire surface for receiving soil. The backside has two parallel spaced. apart vertical protrusions for enclosing a portion of the ground anchor rod when the stabilizer is hammered into the ground juxtaposed to the ground anchor rod. The stabilizer is made from a high strength plastic such as ABS and can withstand loads in excess of four thousand pounds.

6 Claims, 4 Drawing Sheets

GROUND ANCHOR ROD STABILIZER

BACKGROUND OF THE INVENTION

The present invention relates to a ground anchor. More specifically, it refers to a stabilizer used in conjunction with a ground anchor rod for stabilizing the anchor rod in the soil.

A frequent problem is the movement of house trailers, tents and other structures in high winds caused by the pulling free of anchoring posts which have been set in soil. In addition, there is a common problem with fence posts where the bottom portion of the posts move in the soil causing the entire fence to shift and either collapse or become askew. The prior art is replete with methods attempting to stabilize fence posts as shown in U.S. Pat. Nos. 598,003; 624,724 and 672,625. U.S. Pat. No. 897,787 describes a device for stabilizing a shore anchor. U.S. Pat. No. 903,944 describes a spiraling ground anchor device supporting a post and U.S. Pat. No. 911,504 describes a land anchor which has a spiral auger secured to the lower end of a hollow shank. U.S. Pat. No. 1,214,679 describes a fence post anchor which is fined within a lower flange portion of the post. A lower portion of the post has slits which move out around the anchor. Additional patents relating to fence post anchors are U.S. Pat. Nos. 1,764,207; 2,799,369; 3,011,597; and 4,939,877. U.S. Pat. No. 3,032,149 describes a clothes dryer support. The support is a tubular post adapted to be imbedded into the ground. A broad bracing member is connected to an upper end of the tubular post. The vertical post is passed through a sleeve to retain the tubular post in an upright position. U.S. Pat. No. 4,052,827 describes a ground anchor having winged segments that receive an anchoring devices through a hollow interior portion. U.S. Pat. No. 4,756,128 describes a beach anchor having a rod with a bottom end driven into beach sand and an upper end having a handle and a right angle plate surrounding the rod and stabilizing it in the sand.

Although the prior art describes many anchoring devices, the hunt continues for a device that will stabilize ground anchors at high loads such as in excess of four thousand pounds. The present invention solves this problem and differs from the teachings of the prior art by contemplating a plastic plate that can be pounded into the ground juxtaposed to a ground anchor rod.

SUMMARY OF THE INVENTION

A ground anchor rod stabilizer of this invention is a generally rectangular member having multiple thicknesses from a narrow bottom end portion through a thicker top end portion. The front face portion of the ground stabilizer has multiple oval shaped depressions covering its face for receiving soil upon being hammered into the ground. A back side portion of the ground anchor rod stabilizer has a pair of parallel spaced apart vertical protrusions which guide the stabilizer alongside a vertical rod or post which has been pounded into the ground as a ground anchor. The ground anchor stabilizer of this invention is made of high strength plastic and can withstand loads in excess of four thousand pounds. It is an object of this invention to prevent ground anchor rods or posts from pulling free from soil at high loads by providing a method and apparatus for stabilizing the ground anchor at loads exceeding four thousand pounds. These and other objects and aspects of the present invention will be better understood when the following detailed description of the preferred embodiments is read in conjunction with the appended drawing Figures.

SPECIFIC DESCRIPTION OF THE PREFERRED EMBODIMENT

Figure 1:
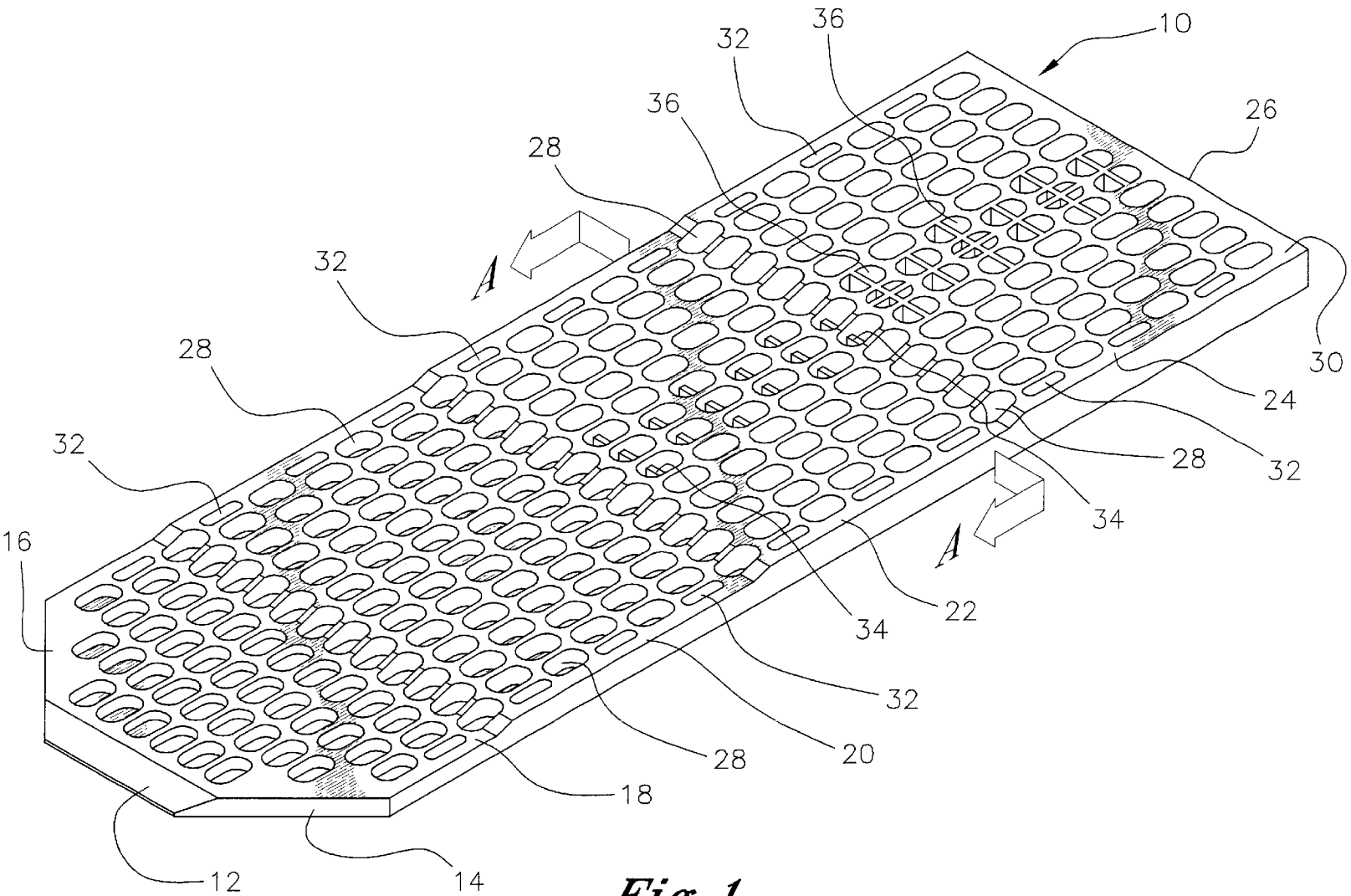
FIG. 1 shows a perspective front face view of the ground anchor stabilizer of this invention.

With reference to FIG. 1, the ground anchor rod stabilizer of the present invention is generally designated by reference numeral 10. The ground anchor rod stabilizer 10 is generally rectangular in shape but has a chamfered bottom end 12 with slanted side portions shown by wails 14 and 16 contained within a first bottom section 18 having a first thickness. A second higher section 20 has a second thickness. A third higher section 22 has a third thickness and a fourth highest section 24 has a fourth thickness. The thickness from the first section to: the fourth section varies from about 2–1 cm. A top edge 26 is flat and is used as a surface for pounding the ground anchor rod stabilizer 10 into the ground. Multiple oval depressions 28 substantially throughout the stabilizer front face 30 provide a means for receiving soil and adding to the stabilization of the ground anchor rod 48. The front and back face have a width of about 20 cm, but it can vary from 15–30 cm. The prepared length of the front and back face is about 60 cm, but this can vary depending on the length of the ground anchor and the type of soil employed. Alternating side depressions 32 have a narrower depression then items 28. Multiple horizontal support rods 34 in the third section 22 provide added strength to the ground anchor stabilizer 10. Additional support is found in the fourth highest section 24 with horizontal support members 36.

Figure 2:
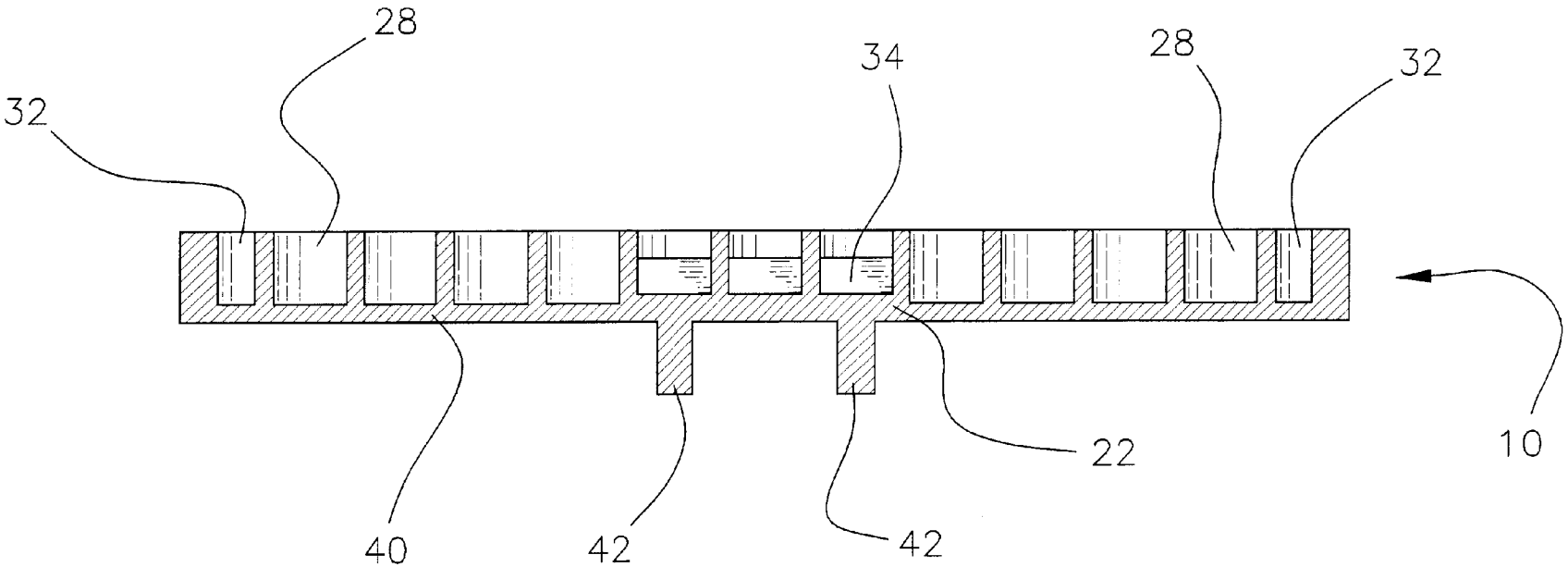
FIG. 2 shows a cross section through the stabilizer along line A—A of FIG. 1
Figure 3:
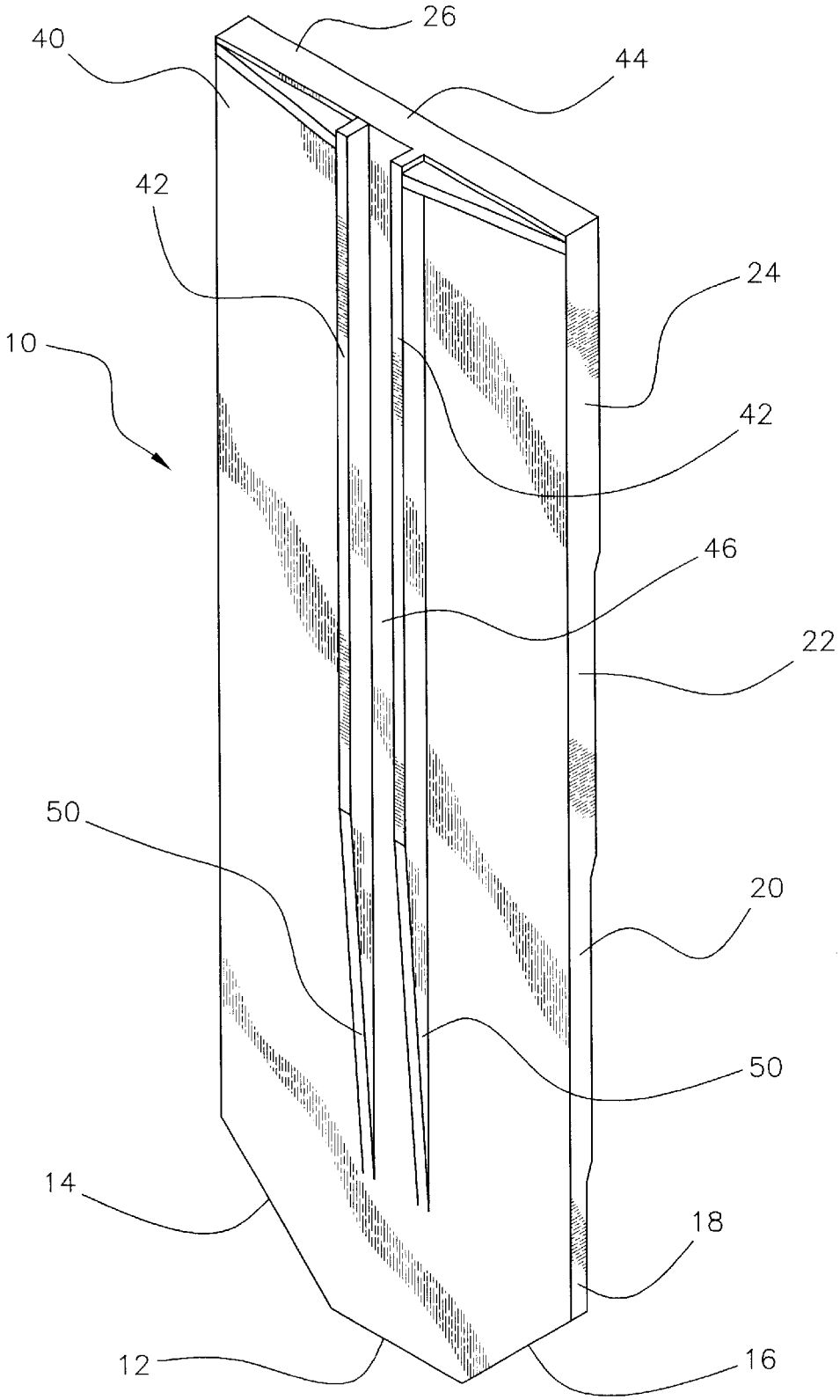
FIG. 3 is a backside elevational view of the ground stabilizer.
Figure 4:
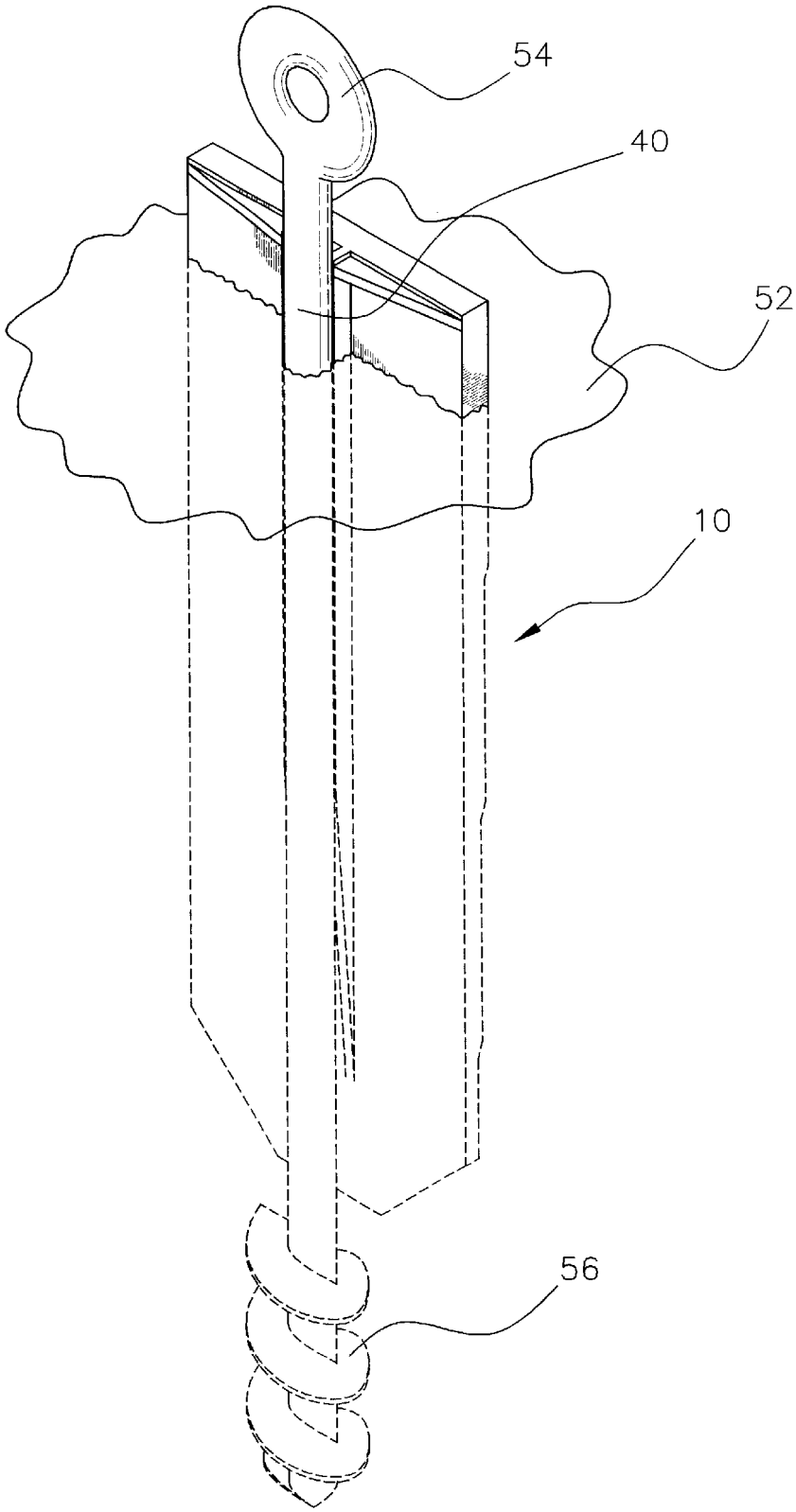
FIG. 4 shows the ground stabilizer juxtaposed along its back portion to a ground anchor rod.

As seen in FIG. 2, the depressions 32 and 28 are open to a depth of approximately ⅘ the thickness of the ground anchor stabilizer. The support members 34 fill a portion of the depressions 28 in the middle of section 22. The backside 40 of the ground anchor rod stabilizer 10 has parallel outward projections 42 that extend vertically substantially along the middle portion 44 of the ground rod stabilizer 10. The projections 42 form a channel 46 to receive ground anchor rod 48. A bottom portion 50 of the projections 42 is tapered to promote easy insertion into the ground. The ground anchor rod stabilizer 10 as shown in FIG. 4 is pounded into the ground so that it projects above the ground surface 52 a short distance. The ground rod 48 has a ring 54 at the top which can be attached to a rope or a cable connecting the ground anchor rod to a tent or a trailer. In the case of a use for supporting fence posts, the ring 54 would not be present. As seen in FIG. 4, the bottom portion of the rod 48 has an auger 56 fixably attached to promote insertion of the rod 48 into the ground. The stabilizer 10 is usually a plastic member made from a high strength plastic or can be high strength aluminum, or steel and is hammered vertically into soil adjacent where an auger rod has been drilled into the soil. The projections 46 surround a portion of the anchor rod 48. The front face 30 receives soil as the stabilizer 10 is pounded into the ground.

This stabilizer 10 resists removal from the soil by a pulling force of over four thousand pounds. The preferred plastic employed for the stabilizer is ABS. However, other high strength plastics as well as aluminum or steel can be used to make the stabilizer 10.

The ground stabilizer 10 is preferably molded in an injection molding process as is well known in the prior art.

Accordingly an invention has been disclosed in terms of a preferred embodiment thereof which fulfills each and every one of the objects of the present invention as set forth herein above and provides a new and useful ground anchor stabilizer of great novelty and utility.

Of course, various changes, modifications and alterations in the teaching of the present invention may be contemplated by those skilled in the art without departing from the intended spirit and scope thereof.

As such, it is intended the present invention only be limited by the terms of the intended claims.

I claim:

1. A method of stabilizing a ground anchor structure in soil comprising:

providing a substantially rectangular stabilizer having a front face and back side, a right and left side portion having a thickness separating the front face and back side, a flat top portion and a tapered inwardly inclined bottom portion, multiple depressions covering substantially all of the front face and a pair of parallel spaced apart vertical rails in the back side;

providing a ground anchor structure vertically affixed in soil; and pounding the stabilizer into the soil adjacent the ground anchor structure, a top portion of the stabilizer remaining above the soil, with the stabilizer back side juxtaposed to the anchor structure and the anchor structure positioned between the vertical rails of the stabilizer so that a force upwardly below 4000 pounds will not cause the ground anchor structure to be removed from the soil.

2. The method of stabilizing a ground anchor structure in soil according to claim 1, wherein the rectangular stabilizer is provided in four portions from a bottom to a top, a bottom portion having a first thickness, a second higher portion having a second greater thickness, a third higher portion having a third greater thickness than the second lighter portion, and a fourth highest portion having a fourth greater thickness than the third higher portion.

3. The method of stabilizing a ground anchor structure in soil according to claim 2, wherein the rectangular stabilizer length from the first portion to the fourth portion about 60 cm.

4. The method of stabilizing a ground anchor structure in soil according to claim 1 wherein the rectangular stabilizer flat top portion receives multiple downwardly directed forces to position the rectangular stabilizer adjacent the ground anchor structure.

5. The method of stabiling a ground anchor structure in soil according to claim 4 wherein the ground anchor structure is provided with an auger at a bottom portion.

6. The method of stabilizing a ground anchor structure in soil according to claim 1 wherein the rectangular stabilizer is provided as ABS plastic.

* * * * *